US006629556B2

(12) United States Patent
Decker et al.

(10) Patent No.: US 6,629,556 B2
(45) Date of Patent: Oct. 7, 2003

(54) CAST TITANIUM COMPRESSOR WHEEL

(75) Inventors: David M. Decker, Brownsburg, IN (US); Steven Roby, Asheville, NC (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 10/140,746

(22) Filed: May 7, 2002

(65) Prior Publication Data

US 2002/0185244 A1 Dec. 12, 2002

Related U.S. Application Data

(62) Division of application No. 09/875,760, filed on Jun. 6, 2001.

(51) Int. Cl.[7] ..... B22C 9/04

(52) U.S. Cl. ..... 164/35; 164/45; 164/516

(58) Field of Search ..... 164/45, 34, 35, 164/36, 516, 517, 518, 519

(56) References Cited

U.S. PATENT DOCUMENTS

| | | | | | |
|---|---|---|---|---|---|
| 2,399,852 | A | * | 5/1946 | Campbell et al. | 416/188 |
| 2,422,615 | A | * | 6/1947 | Halford | 416/188 |
| 4,060,337 | A | * | 11/1977 | Bell, III | 416/186 R |
| 4,093,401 | A | * | 6/1978 | Gravelle | 416/185 |
| 4,139,046 | A | * | 2/1979 | Stanciu | 164/45 |
| 4,556,528 | A | * | 12/1985 | Gersch et al. | 264/221 |
| 4,705,463 | A | * | 11/1987 | Joco | 416/241 R |
| 4,850,802 | A | * | 7/1989 | Pankratz et al. | 416/241 R |
| 4,975,041 | A | * | 12/1990 | Fries et al. | 425/441 |
| 5,114,657 | A | * | 5/1992 | Miyajima | 425/441 |
| 5,215,439 | A | * | 6/1993 | Jansen et al. | 416/183 |
| 5,247,984 | A | * | 9/1993 | Stanciu | 164/45 |
| 5,494,096 | A | * | 2/1996 | De Antonio Gonalons et al. | 164/45 |
| 5,639,217 | A | * | 6/1997 | Ohtsuki et al. | 416/183 |
| 5,705,204 | A | * | 1/1998 | Hofmeister et al. | 425/DIG. 58 |
| 6,019,927 | A | * | 2/2000 | Galliger | 264/221 |
| 6,123,539 | A | * | 9/2000 | Miller | 425/441 |
| 6,164,931 | A | * | 12/2000 | Norton et al. | 416/241 R |

FOREIGN PATENT DOCUMENTS

| | | | | |
|---|---|---|---|---|
| JP | 58-170899 A | * | 10/1983 | 416/188 |
| JP | 58-195098 A | * | 11/1983 | 416/188 |

OTHER PUBLICATIONS

Howmet Titanium Castings, received Apr. 6, 1977m 18 page brochure.*

J. H. Boyle, "Production of Integrally–Cast Airfoil Components for Small Gas Turbine Engines", ASME Publication presented Mar. 4–Mar. 8, 1962 at the Gas Turbine Power Conference and Exhibit, Houston, TX.*

* cited by examiner

*Primary Examiner*—Kuang Y. Lin
(74) *Attorney, Agent, or Firm*—Pendorf & Cutliff; Greg Dziegielewski

(57) ABSTRACT

A compressor wheel is re-designed to permit die inserts (20), which occupy the air passage and define the blades (4, 5) during a process of forming a wax pattern (21) of a compressor wheel, to be pulled without being impeded by the blades. This modified blade design enables the automated production of wax patterns (21) using simplified tooling. These wax patterns (21) can be used in a large-scale investment casting process, and produce an economical cast titanium compressor wheel which performs aerodynamically at high boost pressure/RPM. The compressor wheel improves low cycle fatigue, withstands high temperatures and temperature changes, and permits operation at high boost pressure ratio while, on the other hand, having low weight, low inertial drag, and high responsiveness. The invention further concerns an economical method for operating an internal combustion engine, comprising providing said engine with an easily manufactured, long-life titanium compressor wheel and driving the titanium compressor wheel at high RPM for increasing combustion air throughput and density.

9 Claims, 6 Drawing Sheets

CAST TITANIUM COMPRESSOR WHEEL

This application is a divisional of application Ser. No. 09/875,760 filed Jun. 6, 2001.

FIELD OF THE INVENTION

The present invention concerns a titanium compressor wheel for use in an air boost device, capable of operating at high RPM with acceptable aerodynamic performance, yet capable of being produced economically by an investment casting process.

DESCRIPTION OF THE RELATED ART

Air boost devices (turbochargers, superchargers, electric compressors, etc.) are used to increase combustion air throughput and density, thereby increasing power and responsiveness of internal combustion engines. The design and function of turbochargers are described in detail in the prior art, for example, U.S. Pat. Nos. 4,705,463, 5,399,064, and 6,164,931, the disclosures of which are incorporated herein by reference.

The blades of a compressor wheel have a highly complex shape, for (a) drawing air in axially, (b) accelerating it centrifugally, and (c) discharging air radially outward at elevated pressure into the volute-shaped chamber of a compressor housing. In order to accomplish these three distinct functions with maximum efficiently and minimum turbulence, the blades can be said to have three separate regions.

First, the leading edge of the blade can be described as a sharp pitch helix, adapted for scooping air in and moving air axially. Considering only the leading edge of the blade, the cantilevered or outboard tip travels faster (MPS) than the part closest to the hub, and is generally provided with an even greater pitch angle than the part closest to the hub (see FIG. 1). Thus, the angle of attack of the leading edge of the blade undergoes a twist from lower pitch near the hub to a higher pitch at the outer tip of the leading edge. Further, the leading edge of the blade generally is bowed, and is not planar. Further yet, the leading edge of the blade generally has a "dip" near the hub and a "rise" or convexity along the outer third of the blade tip. These design features are all designed to enhance the function of drawing air in axially.

Next, in the second region of the blades, the blades are curved in a manner to change the direction of the airflow from axial to radial, and at the same time to rapidly spin the air centrifugally and accelerate the air to a high velocity, so that when diffused in a volute chamber after leaving the impeller the energy is recovered in the form of increased pressure. Air is trapped in airflow channels defined between the blades, as well as between the inner wall of the compressor wheel housing and the radially enlarged disc-like portion of the hub which defines a floor space, the housing-floor spacing narrowing in the direction of air flow.

Finally, in the third region, the blades terminate in a trailing edge, which is designed for propelling air radially out of the compressor wheel. The design of this blade trailing edge is generally complex, provided with (a) a pitch, (b) an angle offset from radial, and/or (c) a back taper or back sweep (which, together with the forward sweep at the leading edge, provides the blade with an overall "S" shape). Air expelled in this way has not only high flow, but also high pressure.

Recently, tighter regulation of engine exhaust emissions has led to an interest in even higher pressure ratio boosting devices. However, current compressor wheels are not capable of withstanding repeated exposure to higher pressure ratios (>3.8). While aluminum is a material of choice for compressor wheels due to low weight and low cost, the temperature at the blade tips, and the stresses due to increased centrifugal forces at high RPM, exceed the capability of conventionally employed aluminum alloys. Refinements have been made to aluminum compressor wheels, but due to the inherent limited strength of aluminum, no further significant improvements can be expected. Accordingly, high pressure ratio boost devices have been found in practice to have short life, to be associated with high maintenance cost, and thus have too high a product life cost for widespread acceptance.

Titanium, known for high strength and low weight, might at first seem to be a suitable next generation material. Large titanium compressor wheels have in fact long been used in turbojet engines and jet engines from the B-52B/RB-52B to the F-22. However, titanium is one of the most difficult metals to work with, and currently the cost of production associated with titanium compressor wheels is so high as to limit wide spread employment of titanium.

There are presently no known cost-effective manufacturing techniques for manufacturing automobile or truck industry scale titanium compressor wheels. The automotive industry is driven by economics. While there is a need for a high performance compressor wheel, it must be capable of being manufactured at reasonable cost.

One example of a patent teaching casting of compressor wheels is U.S. Pat. No. 4,556,528 (Gersch et al) entitled "Method and Device for Casting of Fragile and Complex Shapes". This patent illustrates the complex design of compressor wheels (as discussed in detail above), and the complex process involved in forming a resilient pattern for subsequent use in forming molds. More specifically, Gersch et al teach a process involving placing a solid positive resilient master pattern of an impeller into a suitable flask, pouring a flexible and resilient material, such as silastic or platinum rubber material, over the master pattern, curing, and withdrawing the solid master pattern of the impeller from the flexible material to form a flexible mold with a reverse or negative cavity of the master pattern. A flexible and resilient curable material is then poured into the cavity of the reverse mold. After the flexible and resilient material cures to form a positive flexible pattern of the impeller, it is removed from the flexible negative mold. The flexible positive pattern is then placed in an open top metal flask, and foundry plaster is poured into the flask. After the plaster has set up, the positive flexible pattern is removed from the plaster, leaving a negative plaster mold. A non-ferrous molten material (e.g., aluminum) is poured into the plaster mold. After the non-ferrous molten material solidifies and cools, the plaster is destroyed and removed to produce a positive non-ferrous reproduction of the original part.

While the Gersch et al process is effective for forming cast aluminum compressor wheels, it is limited to non-ferrous or lower temperature or minimally reactive casting materials and cannot be used for producing parts of high temperature casting materials such as ferrous metals and titanium. Titanium, being highly reactive, requires a ceramic shell.

U.S. Pat. No. 6,019,927 (Galliger) entitled "Method of Casting a Complex Metal Part" teaches a method for casting a titanium gas turbine impeller which, though different in shape from a compressor wheel, does have a complex geometry with walls or blades defining undercut spaces. A flexible and resilient positive pattern is made, and the pattern is dipped into a ceramic molding media capable of drying and hardening. The pattern is removed from the media to form a ceramic layer on the flexible pattern, and the layer is coated with sand and air-dried to form a ceramic layer. The dipping, sanding and drying operations are repeated several times to form a multi-layer ceramic shell. The flexible wall pattern is removed from the shell, by partially collapsing with suction if necessary, to form a first ceramic shell mold with a negative cavity defining the part. A second ceramic shell mold is formed on the first shell mold to define the back of the part and a pour passage, and the combined shell molds are fired in a kiln. A high temperature casting material is poured into the shell molds, and after the casting material solidifies, the shell molds are removed by breaking.

It is apparent that the Galliger gas turbine flexible pattern is (a) collapsible and (b) is intended for manufacturing large-dimension gas turbine impellers for jet or turbojet engines. This technique is not suitable for mass-production of automobile scale compressor wheels with thin blades, using a non-collapsing pattern. Galliger does not teach a method which could be adapted to in the automotive industry.

In addition to the above "rubber pattern" technique for forming casting molds, there is a well-known process referred to as "investment casting" which can be used for making compressor wheels and which involves:

(1) making a wax pattern of a hub with cantilevered airfoils,
(2) casting a refractory mass about the wax pattern,
(3) removing the wax by solvent or thermal means, to form a casting mold,
(4) pouring and solidifying the casting, and
(5) removing the mold materials.

There are however significant problems associated with the initial step of forming the compressor wheel wax pattern. Whenever a die is used to cast the wax pattern, the casting die must be opened to release the product. Herein, the several parts of the die (die inserts) must each be retracted, generally only in a straight (radial) line.

As discussed above, the blades of a compressor wheel have a complex shape. The complex geometry of the compressor wheel, with undercut recesses and/or back tapers created by the twist of the individual air foils with compound curves, not to mention dips and humps along the leading edge of the blade, impedes the withdrawal of die inserts.

In order to side-step these complexities, it has been known to fashion separate molds for each of the wax blades and for the wax hub. The separate wax blades and hub can then be assembled and fused to form a wax compressor wheel pattern. However, it is difficult to assemble a compressor pattern from separate wax parts with the required degree of precision—including coplanerism of airfoils, proper angle of attack or twist, and equal spacing. Further, stresses are encountered during assembling lead to distortion after removal from the assembly fixture. Finally, this is a labor intensive and thus expensive process. This technique cannot be employed on an industrial scale.

Certainly, titanium compressor wheels would seem desirable over aluminum or steel compressor wheels. Titanium is strong and light-weight, and thus lends itself to producing thin, light-weight compressor wheels which can be driven at high RPM without over-stress due to centrifugal forces.

However, as discussed above, titanium is one of the most difficult materials to work with, resulting in a prohibitively high cost of manufacturing compressor wheels. This manufacturing cost prevents their wide-spread employment. No new technology will be adopted industrially unless accompanied by a cost benefit.

There is thus a need for a simple and economical method for mass producing titanium compressor wheels, and for the low-cost titanium compressor wheels produced thereby. The method must be capable of reliably and reproducibly producing compressor wheels, without suffering from the prior art problems of dimensional or structural imperfections, particularly in the thin blades.

SUMMARY OF THE INVENTION

The present invention addressed the problem of whether it would be possible to design a titanium compressor wheel for boosting air pressure and throughput to an internal combustion engine and satisfying the following two (seemingly contradictory) requirements:

aerodynamically: the aerodynamic efficiency, when operating at the high RPM at which titanium compressor wheels are capable of operating, must be comparable to the efficiency of the complex state-of-the-art compressor wheel designs, and manufacturability: the compressor wheels must be capable of being mass produced in a manner that is more efficient than the conventionally employed methods described above.

The problem was solved by the present inventors in a surprising manner. Simply stated, the present inventors approached this problem by standing it on it's head. Traditionally, a manufacturing process begins by designing a product, and then devising a processes for making that product. Most compressor wheels are designed for optimum aerodynamic efficiency, and thus have narrow blade spacing and complex leading and trailing edge design (excess rake, undercutting and backsweep, complex bowing and leading edge hump and dip).

The present invention was surprisingly made by departing from the conventional engineering approach and by looking first not at the end product, but rather at the various processes for producing the wax pattern. The inventors then designed various compressor wheels on the basis of "pullability"—ability to be manufactured using die inserts which are pullable—and then tested the operational properties of various compressor wheels produced from these simplified patterns at high RPM, with repeated load cycles, and for long periods of time (to simulate long use in practical environment). The result was a simplified compressor wheel design which (a) lends itself to economical production by casting of titanium, and (b) at high RPM has an entirely satisfactory aerodynamic performance.

More specifically, the invention provides a titanium compressor wheel with a simplified blade design, which will aerodynamically have a degree of efficiency comparable to that of a complex compressor wheel blade design, aid yet which, form a manufacturing aspect, can be produced economically in an investment casting process (lost wax process) using a wax pattern easily producible at low cost from an automated (and "pullable") die.

As a result of this discovery, the economic equation has shifted for the first time in favor of the titanium compressor wheel for general automotive technology.

Accordingly, in a first embodiment, the invention concerns a compressor wheel of simplified blade design, such that:

a wax pattern can be formed in a die consisting of one or more die inserts per compressor wheel air passage (i.e., the space between the blades), and preferably two die inserts per air passage, and the die inserts can automatically be extracted radially or along some compound curve or axis in order to expose the wax pattern for easy removal.

The compressor wheel blades may have curvature, and may be of any design so long as the blade leading edges have no dips and no humps, and the blades have no undercut recesses and/or back tapers created by the twist of the individual air foils with compound curves of a magnitude which would prevent extracting the die inserts radially or along some curve or arc in a simple manner.

In simplest form, the wax mold is produced from a die having one die insert corresponding to each air passage. This is possible where the blades are designed to permit pulling of simple die inserts (i.e., one die insert per air passage). However, as discussed below, teach die can be comprised of two or more die inserts of each passage, with two inserts per air passage being preferred for reasons of economy.

In a more advanced form, the blades are designed with some degree of rake or backsweep or curvature, but only to the extent that two or more, preferably two inserts, per air passage can be easily automatically extracted. Such an arrangement, though slightly increasing the cost and complexity of the wax mold tooling, would permit manufacture of wax molds, and thus compressor wheels, with greater complexity of shape. In the case of two inserts per air passage, the pull direction would not necessarily be the same for each member of the pair of inserts. The one die insert, defining one area of the air passage between two blades, may be pulled radially with a slight forward tilt, while a second die insert, defining the rest of the passage, may be pulled along a slight arc due to the slight backsweep of the blade. This embodiment is referred to as a "compound die insert" embodiment. One way of describing pullability is that the blade surfaces are not convex. That is, a positive draft exists along the pull axis.

Once the wax pattern is formed, the titanium investment casting process continues in the conventional manner.

The invention further concerns an economical method for operating an internal combustion engine, comprising providing said engine with an easily manufactured, long-life titanium compressor wheel and driving the titanium compressor wheel at high RPM for increasing combustion air throughput and density and reducing emissions.

The titanium compressor wheel of the present invention has a design lending itself to being produced in a simplified, highly automated process.

The foregoing has outlined rather broadly the more pertinent and important features of the present invention in order that the detailed description of the invention that follows may be better understood, and so that the present contribution to the art can be more fully appreciated. Additional features of the invention will be described hereinafter, which form the subject of the claims of the invention. It should be appreciated by those skilled in the art that the conception and the specific embodiments disclosed may be readily utilized as a basis for modifying or designing other compressor wheels for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of the present invention reference should be made by the following detailed description taken in with the accompanying drawings in which:

FIG. 12 an elevated perspective view showing a tool for making a compressor wheel pattern with six full and six splitter blades, the tool comprising six upper and twelve lower die inserts;

FIG. 13 shows the tool of FIG. 12, with the six upper die inserts retracted;

FIG. 14 shows the tool of FIG. 13, omitting the six upper die inserts, and with the twelve lower die inserts retracted;

FIG. 15 shows a tool similar to that shown in FIG. 12, differing only in that each of the air passages adjacent the splitter blades are filled by two die inserts, rather than a single die insert, making a total of six total upper die inserts and twenty-four lower die inserts;

FIG. 16 shows the tool of FIG. 15, with the six upper die inserts retracted;

FIG. 17 shows the tool of FIG. 16, omitting the six upper die inserts, and with the twenty-four lower die inserts retracted.

DETAILED DESCRIPTION OF THE INVENTION

Figure 1:
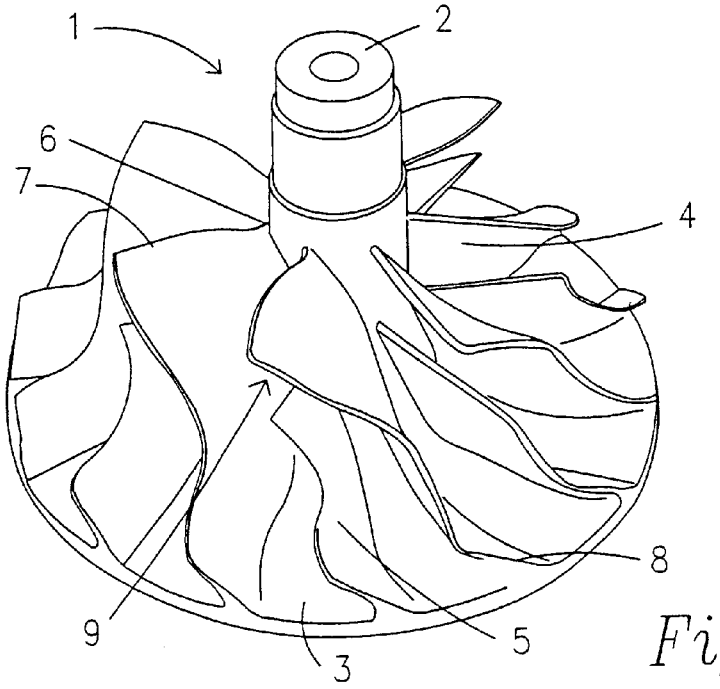
Fig. 1 PRIOR ART
FIG. 1 shows a compressor wheel of prior art design in elevated perspective view.

One major aspect of the present invention is based on an adjustment of an aerodynamically acceptable design or blade geometry so as to make a wax pattern, from which the cast titanium compressor wheel is produced, initially producible in an automatic die as a unitized, complete shape. The invention provides a simplified blade design which (a) allows production of wax patterns using simplified tooling and (b) is aerodynamically effective. This modified blade design is at the root of a simple and economical method for manufacturing cast titanium compressor wheels.

The invention provides for the first time a process by which titanium compressor wheels can be mass produced by a simple, low cost, economical process. In the following the invention will first be described using simple die inserts, i.e., one die insert per air passage, after which an embodiment having compound die inserts, i.e., two or more die inserts per air passage, will be described.

The term "titanium compressor wheel" is used herein to refer to a compressor wheel comprised predominantly of titanium, and includes titanium alloys, preferably light weight alloys such as titanium aluminum alloy.

As the starting point for understanding the present invention, it must be understood that the shape, contours and curvature of the blades are modified to provide a design which, on the one hand, provides aerodynamically acceptable characteristics at high RPM, and on the other hand, makes it possible to produce a wax pattern economically using an automatic compound die. That is, it is central to the invention that die inserts used to define the air passages during casting of the wax pattern are "pullable", i.e., can be withdrawn radially or along a curvature. In order to make the die inserts retractable, the following aspects were taken into consideration:

- the compressor wheel must have adequate blade spacing;
- the compressor wheel may not exhibit excess rake and/or backsweep of the blade leading edge or trailing edge,
- there may not be excessive twist in the blades,
- there may be no dips or humps along the leading edge of the blade which would prevent pulling of the die inserts,
- there may not be excessive bowing of the blade, and
- the die inserts used in forming the wax pattern must be extractable along a straight line or a simple curve.

Once the wax pattern satisfying the above requirements has been produced, the remainder of the casting technique can be traditional investment casting, with modifications as known in the art for casting titanium. A wax pattern is dipped into a ceramic slurry multiple times. After a drying process the shell is "de-waxed" and hardened by firing. The next step involves filling the mold with molten metal. Molten titanium is very reactive and requires a special ceramic shell material with no available oxygen. Pours are also preferably done in a hard vacuum. Some foundries use centrifugal casting to fill the mold. Most use gravity pouring with complex gating to achieve sound castings. After cool-down, the shell is broken and removed, and the casting is given special processing to remove the mold-metal reaction layer, usually by chemical milling.

Some densification by HIP (hot isostatic pressing) may be needed if the process otherwise leaves excessive internal voids.

The invention will now be described in greater detail by way of comparing the compressor wheel of the invention to a compressor wheel of the prior art, for which reference is made to the figures.

Figure 3:
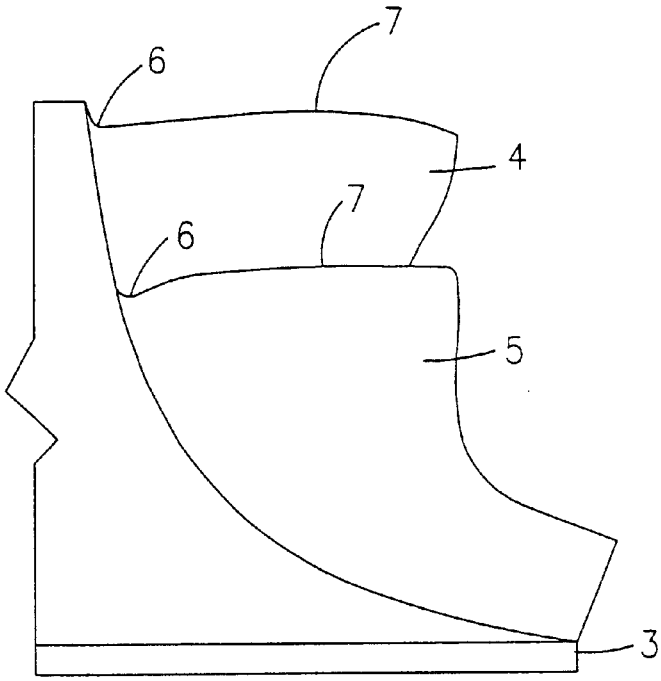
Fig. 3 PRIOR ART
FIG. 3 shows a partial compressor wheel of prior art design in side profile view.

FIGS. 1 and 3 show a prior art compressor wheel 1, comprising an annular hub 2 which extends radially outward at the base part to form a base 3. The transition from hub to base may be curved (fluted) or may be angled. A series of evenly spaced thin-walled full blades 4 and "splitter" blades 5 are form an integral part of the compressor wheel. Splitter blades differ from full blades mainly in that their leading edge begins further axially downstream as compared to the full blades. The compressor wheel is located in a compressor housing, with the outer free edges of the blades passing close to the inner wall of the compressor housing. As air is drawn into the compressor inlet, passes through the air channels of the rapidly rotating compressor wheel, and is thrown (centrifugally) outwards along the base of the compressor wheel into an annular volute chamber, and this compressed air is then conveyed to the engine intake. It is readily apparent that the complex geometry of the compressor wheel, with dips 6 and humps 7 along the blade leading edge, undercut recesses 9 created by the twist of the individual air foils with compound curves, and rake or back tapers (back sweep) 8 at the blade trailing edge, would make it impossible to cast such a shape in one piece in an automatic process, since the geometry would impede the withdrawal of die inserts or mold members.

Figure 2:
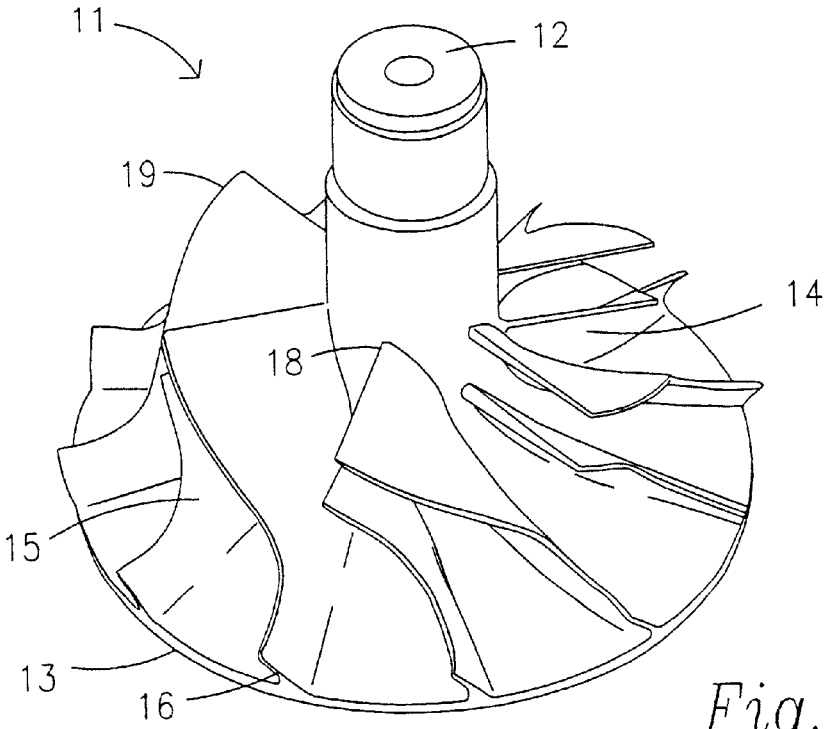
FIG. 2 shows, in comparison to FIG. 1, a compressor wheel designed in accordance with the present invention, in elevated perspective view.
Figure 4:
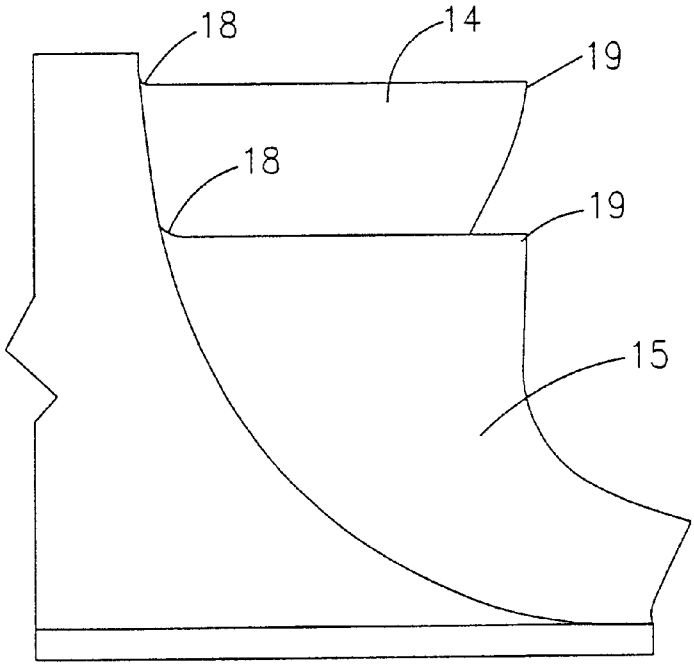
FIG. 4 shows, in comparison to FIG. 3, a partial compressor wheel designed in accordance with the present invention, in side profile view.

FIGS. 2 and 4, in comparison, show a compressor wheel according to the present invention, designed beginning foremost with the idea of making die inserts easily retractable, and thus taking into consideration the interrelated concepts of adequate blade spacing, absence of excess rake and/or backsweep of the blade leading edge and trailing edge, absence of dips or humps along the leading edge, and extractability of die inserts along a straight line or a simple curve. Simply stated, the main characterizing feature of the present invention is the absence of blade features which would prevent "pullability" of die inserts.

These design considerations result, as seen in FIGS. 2 and 4, in a compressor wheel 11 (the wax pattern being identical in shape to the final titanium product, the figures could be seen as showing either the wax pattern or the cast titanium compressor wheel) with a hub 12 having a hub base 13, and a series of evenly spaced thin walled full blades 14 and "splitter" blades 15 cast as an integral part of the compressor wheel.

It can be seen that the leading edge 17 of the blades are essentially straight, having no dips or humps which would impede radial extraction of die inserts. That is, there may be a slight rounding up 18 (i.e., continuation of the blade along the blade pitch) where the blade joins the hub, but this curvature does not interfere with pullability of die inserts.

It can be seen that the blade spacing is wide enough and that any rake and/or backsweep of the blades is not so great as to impede extraction of the inserts along a straight line or a simple curve.

Figure 11:
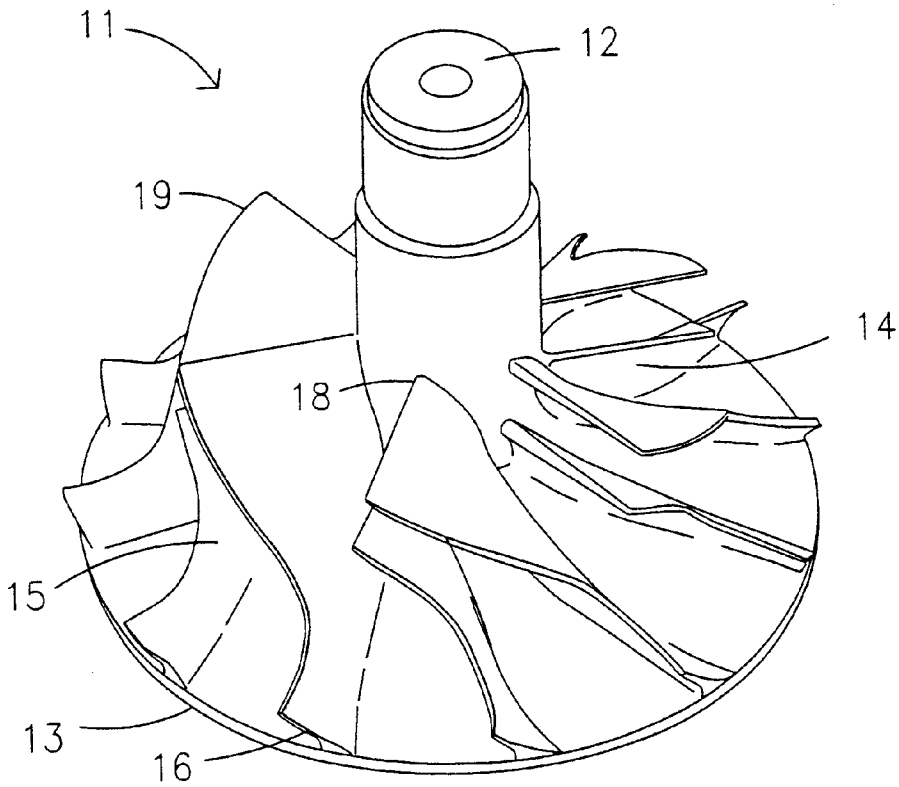
FIG. 11 shows a compressor wheel according to the invention, with slightly backswept trailing edge, for production using compound die inserts.

Trailing edge 16 of the blade 14 may in one design extend relatively radially outward from the center of the hub (the hub axis) or, more preferably, may extend along an imaginary line from a point on the outer edge of the hub disk to a point on the outer (leading) circumference of the hub shaft. The trailing edge of the blade, viewed from the side of the compressor wheel may be oriented parallel to the hub axis, but is preferably cantilevered beyond the base of the hub and extends beyond the base triangularly, as shown in FIG. 2, and is inclined with a pitch which may be the same as the rest of the blade, or may be increased. Finally, as shown in FIG. 11, the blade may have a small amount of backsweep (which, when viewed with the forward sweep of the leading edge, produced a slight "S" shape) but the area of the blade near the trailing edge is preferably relatively planar.

In a basic embodiment, the compressor wheel has from 8 to 12 full blades and no splitter blades. In a preferred embodiment, the compressor wheel has from 4 to 8, preferably 6, full blades and an equal number of splitter blades.

FIG. 3 shows a partial compressor wheel of prior art design in side profile view, with the blade leading edge exhibiting a dip 6 and a hump 7 producing a shape which would interfere with radial extraction of die inserts.

FIG. 4 shows a partial compressor wheel similarly dimensioned to the wheel of FIG. 3, but as can be seen, with a substantially straight shoulder of the blade from neck 18 to tip 19.

Figure 5:
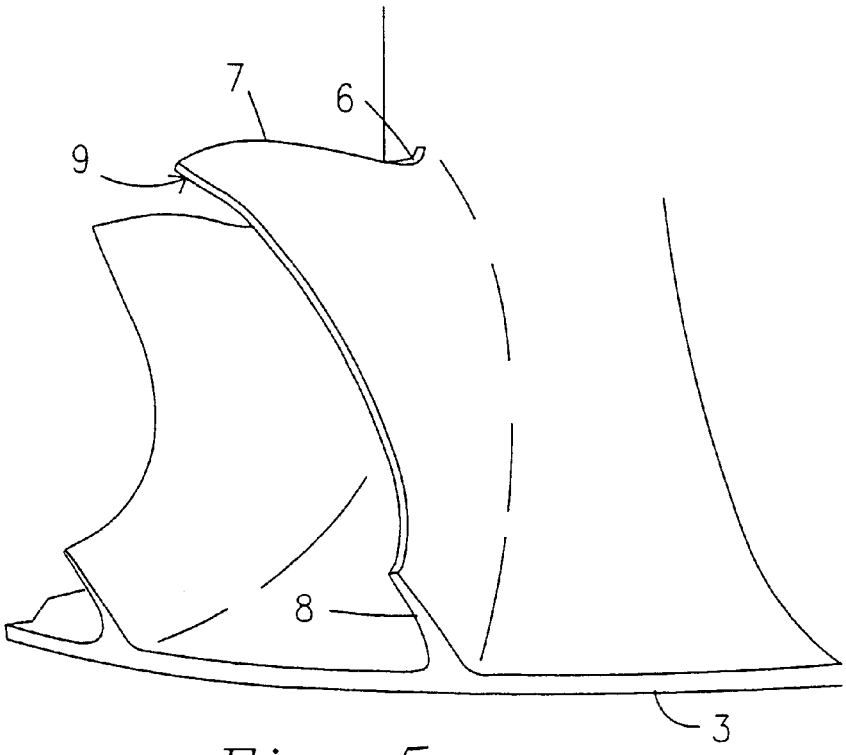
Fig. 5 PRIOR ART
FIG. 5 shows an enlarged partial section of a compressor wheel of prior art design in elevated perspective view.

FIG. 5 shows an enlarged partial section of a compressor wheel of a prior art design in elevated perspective view, illustrating dip 6, hump 7, and bowing and curvature of the leading edge. It can also be seen that the "twist" (difference in pitch along the leading edge), in addition to the curvature, would make it impossible to radially extract a die insert.

Figure 6:
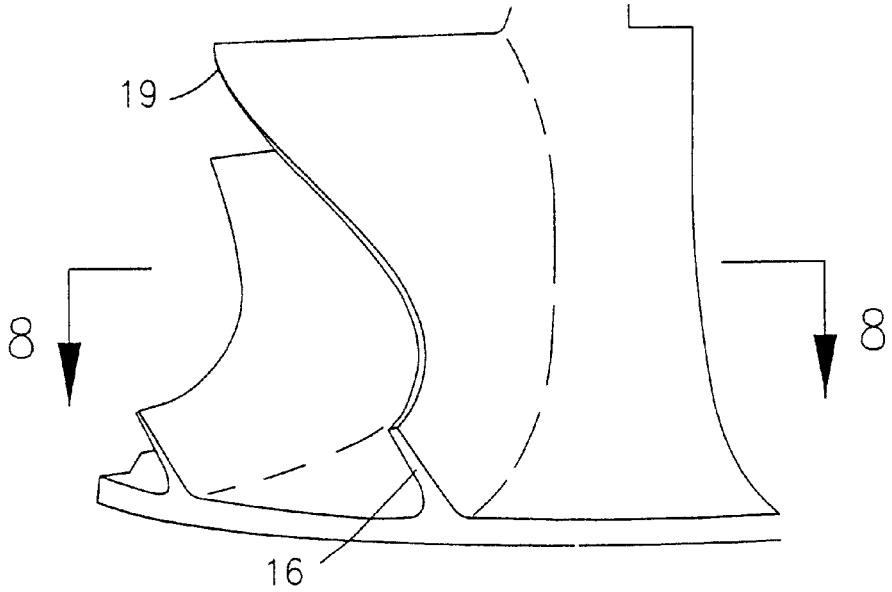
FIG. 6 shows, in comparison to FIG. 5, an enlarged partial section of a compressor wheel designed in accordance with the present invention, in elevated perspective view.

FIG. 6 shows an enlarged partial section of a partial compressor wheel according to the invention, similarly dimensioned to FIG. 5, but designed in accordance with the present invention, showing a straight leading edge 19 and an absence of any degree of twist and curvature which would prevent pulling of die inserts.

Obviously, the above dimensions refer equally to the wax pattern and the finished compressor wheel. The wax pattern differs from the final product mainly in that a wax funnel is included. This produces in the ceramic mold void a funnel into which molten metal is poured during casting. Any excess metal remaining in this funnel area after casting is removed from the final product, usually by machining.

Figure 7:
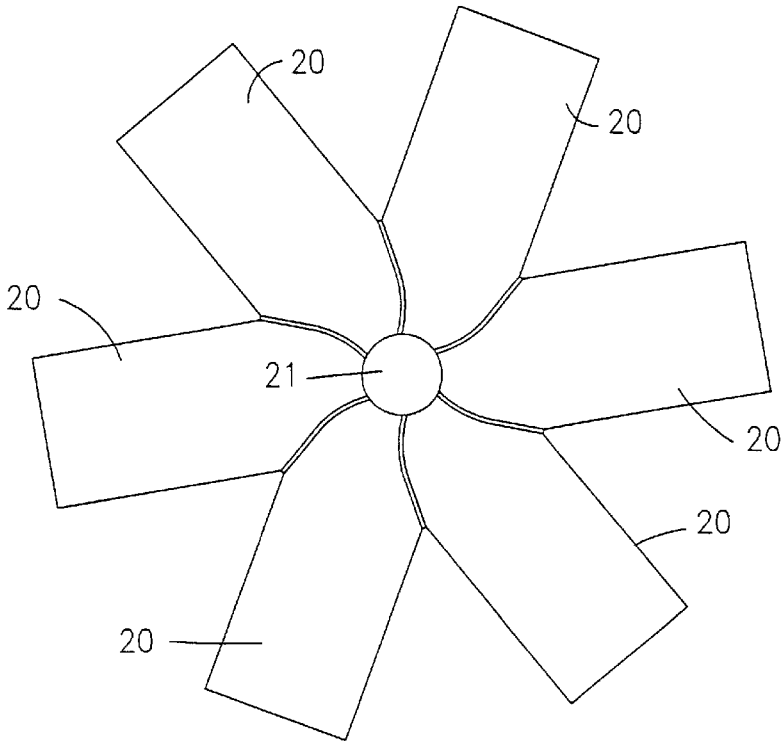
FIG. 7 shows a simplified section, perpendicular to the rotation axis of the compressor wheel, with die inserts defining the hub and blades of a compressor wheel.
Figure 8:
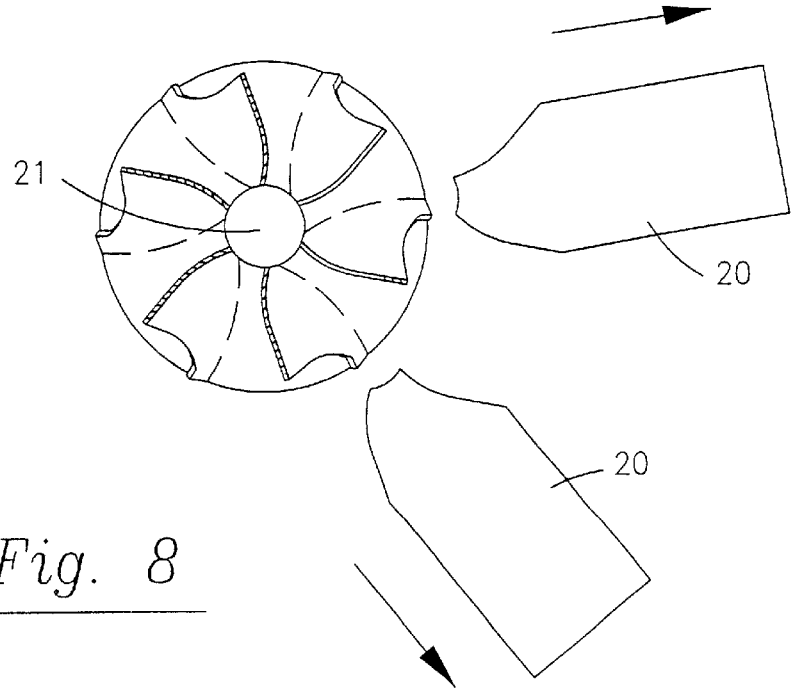
FIG. 8 corresponds to FIG. 7 and shows a top view onto a compressor wheel sectioned perpendicular to the rotation axis at about the center of the hub.
Figure 9:
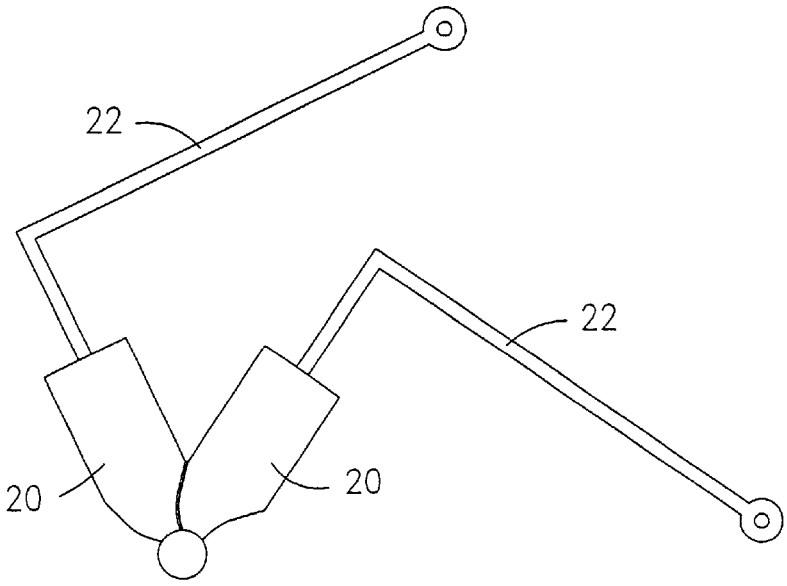
FIGS. 9 and 10 show a simplified arrangement for extracting a die along a simple curve.
Figure 10:
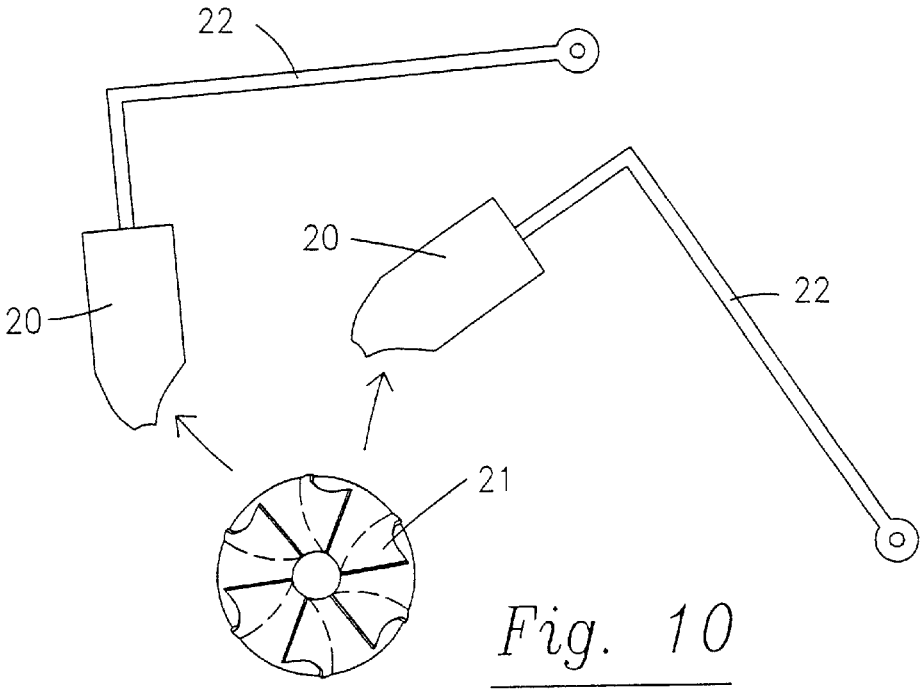

In FIG. 7 the tool or die for forming the wax form is shown in closed condition, in sectional view along section line 8 shown in FIG. 6, and simplified (omitting mechanical extraction means, etc.) for better understanding of the essential feature of the invention, revealing a cross section through a compressor wheel shaped mold. The mold defines a hub cavity and a number of inserts 20 that occupy the air passages between the blades, thus defining the blades, the walls of the hub, and the floor of the air passage at the base of the hub. With these inserts in place as shown in FIG. 7, molten wax is poured into the die. The wax is allowed to cool and the individual inserts 20 are automatically extracted radially as shown in FIG. 8 or along some simple or compound curve as shown in FIGS. 9 and 10 in order to expose the solid wax pattern 21 and make possible the removal of the pattern from the die. FIGS. 7 and 8 illustrate radial extraction, FIGS. 9 and 10 in comparison illustrate extraction along a simple curve, using offset arms 22.

FIGS. 7–10 show six die inserts 20 and six blades for ease of illustration; however, as discussed above, the die preferably has a total of either twelve full length die inserts for making twelve full blades or, alternatively, eighteen die inserts, with six die inserts 20*a* for making the upper portion of the full blades 14 and twelve die inserts 20*b* for defining the spaces between the full blades 14 and the splitter blades 15. FIG. 12 shows a tool or die for making a compressor wheel pattern with six full and six "splitter" blades, the tool comprising six upper die inserts 20*a* and twelve lower die inserts 20*b*. FIG. 13 shows the tool of FIG. 12, with the six upper die inserts 20*a* retracted. FIG. 14 shows the tool of FIG. 13, omitting the six upper die inserts, and with the twelve lower die inserts 20*b* retracted, exposing the positive pattern with full blades 14 and splitter blades 15. FIG. 15 shows a tool similar to that shown in FIG. 12, differing only in that each of the air passages adjacent the splitter blades 15 are filled by two die inserts 20*b'*, 20*b''*, rather than a single die insert, making a total of six total upper die inserts 20*a* and twenty-four lower die inserts 20*b'*, 20*b''*. FIG. 16 shows the tool of FIG. 15, with the six upper die inserts 20*a* retracted. FIG. 17 shows the tool of FIG. 16, omitting the six upper die inserts, and with the twenty-four lower die inserts 20*b'*, 20*b''* retracted.

The wax casting process according to the invention occurs fully automatically. The inserts are assembled to form a mold, wax is injected, and the inserts are timed by a mechanism to retract in unison.

Once the wax pattern (with pour funnel) is formed, the ceramic mold forming process and the titanium casting process are carried out in conventional manner. The wax pattern with pour funnel is dipped into a ceramic slurry, removed from the slurry and coated with sand or vermiculite to form a ceramic layer on the wax pattern. The layer is dried, and the dipping, sanding and drying operations are repeated several times to create a multiple layer ceramic shell mold enclosing or encapsulating the combined wax pattern. The shell mold and wax patterns with pour funnel are then placed within a kiln and fired to remove the wax and harden the ceramic shell mold with pour funnel.

Molten titanium is poured into the shell mold, and after the titanium hardens, the shell mold is removed by destroying the mold to form a light weight, precision cast compressor wheel capable of withstanding high-RPM and high temperatures.

The titanium compressor wheel of the present invention has a design lending itself to being produced in a simplified, highly automated process. As a result, the compressor wheel is not liable to any deformities as might result when using an elastic deformable mold, or when assembling separate blades onto a hub, according to the procedures of the prior art.

Tested against an aluminum compressor wheels of similar design, the aluminum compressor wheel as not capable of withstanding repeated exposure to higher pressure ratios, while the titanium compressor wheel showed no signs of fatigue even when run through thirteen or more times the number of operating cycles as the aluminum compressor wheel.

Although this invention has been described in its preferred form with a certain degree of particularity with respect to a titanium compressor wheel, it is understood that the present disclosure of the preferred form has been made only by way of example and that numerous changes in the details of structures and the composition of the combination may be resorted to without departing from the spirit and scope of the invention.

FIG. 11 shows a compressor wheel which corresponds essentially to the compressor wheel of FIG. 2, except that a modest amount of backsweep is provided at the trailing edge 16 of the blade. This small amount of backsweep, taken with the forward rake along the leading edge of the blade, might make it difficult to easily extract a single die insert defining an entire air passage. To facilitate die insert removal, the compressor wheel shown in FIG. 11 can be produced using compound die inserts, i.e., a first die insert for defining the initial or inlet area of the air passage, and a second die insert for defining the remaining air passage area. The manner in which the air passage is divided into two areas is not particularly critical, it is merely important that the first and second die insert can be withdrawn either simultaneously or sequentially.

Although a cast titanium compressor wheel has been described herein with great detail with respect to an embodiment suitable for the automobile or truck industry, it will be readily apparent that the compressor wheel and the process for production thereof are suitable for use in a number of other applications, such as fuel cell powered vehicles. Although this invention has been described in its preferred form with a certain of particularity with respect to an automotive internal combustion compressor wheel, it is understood that the present disclosure of the preferred form has been made only by way of example and that numerous changes in the details of structures and the composition of the combination may be resorted to without departing from the spirit and scope of the invention.

Now that the invention has been described,

We claim:

1. A method for manufacturing a titanium centrifugal compressor wheel, said method comprising:

introducing a sacrificial material into a die comprised of a plurality of rigid die inserts (20) to form a compressor wheel pattern comprising a hub (1) defining an axis of rotation and backswept aerodynamic blades (4, 5) carried on said hub, extracting said die inserts (20) radially or along a curve to expose said compressor wheel pattern, forming a mold by a lost wax process around said compressor wheel pattern (21), forming said titanium compressor wheel by investment casting in said mold.

2. A method as in claim 1, wherein said die insert retraction is by an automated process.

3. A method as in claim 2, wherein said automated process is a hydraulic, pneumatic, or electric process.

4. A method as in claim 1, wherein said die comprises one die insert (20, 20') to define each of said air passages between adjacent blades.

5. A method as in claim 1, wherein said aerodynamic blades comprise alternating full blades (4) and splitter blades (5).

6. A method as in claim 1, wherein said titanium compressor wheel is formed of a titanium-aluminum alloy.

7. A method for manufacturing a cast titanium centrifugal compressor wheel comprising:

designing a compressor wheel pattern shape with an annular hub (1) and a plurality of backswept blades (4, 5), each blade including a leading edge (18), an outer edge adapted for close passage to a compressor housing, and a trailing edge (16), wherein said leading edge (18) is substantially a straight edge, and wherein said blades (4, 5) define air passages between adjacent blades and are contoured such that each of said air passages between adjacent blades can be defined by not more than three die inserts (20) inserted between adjacent blades and respectively retractable along a radial or curved path by an automated process, forming a pattern of said compressor wheel by introducing a sacrificial material into a die comprised of a plurality of rigid die inserts (20), automatically extracting said rigid die inserts (20) radially or along a curve to expose said compressor wheel pattern, forming a mold by a lost wax process around said compressor wheel pattern (21), forming said titanium compressor wheel by investment casting in said mold.

8. A method as in claim 7, wherein said blades comprise full blades and splitter blades.

9. A method as in claim 7, wherein said titanium compressor wheel is formed of a titanium-aluminum alloy.

* * * * *

US006629556C1

(12) INTER PARTES REEXAMINATION CERTIFICATE (592nd)

United States Patent
Decker et al.

(10) Number: US 6,629,556 C1
(45) Certificate Issued: May 2, 2013

(54) CAST TITANIUM COMPRESSOR WHEEL

(75) Inventors: David M. Decker, Brownsburg, IN (US); Steven Roby, Asheville, NC (US)

(73) Assignee: Borgwarner, Inc., Troy, MI (US)

Reexamination Request:

No. 95/000,434, Jan. 29, 2009

No. 90/009,083, Apr. 18, 2008

Reexamination Certificate for:

| | |
|---|---|
| Patent No.: | **6,629,556** |
| Issued: | **Oct. 7, 2003** |
| Appl. No.: | **10/140,746** |
| Filed: | **May 7, 2002** |

Related U.S. Application Data

(62) Division of application No. 09/875,760, filed on Jun. 6, 2001, now Pat. No. 6,663,347.

(51) Int. Cl.

| | |
|---|---|
| ***F04D 29/02*** | (2006.01) |
| ***F04D 29/00*** | (2006.01) |
| ***F04D 29/28*** | (2006.01) |
| ***B22C 7/00*** | (2006.01) |
| ***B22C 7/02*** | (2006.01) |
| ***B22C 9/04*** | (2006.01) |

(52) U.S. Cl.
USPC ..... 164/35; 164/45; 164/516

(58) Field of Classification Search
None
See application file for complete search history.

(56) References Cited

To view the complete listing of prior art documents cited during the proceedings for Reexamination Control Numbers 95/000,434 and 90/009,083, please refer to the USPTO's public Patent Application Information Retrieval (PAIR) system under the Display References tab.

*Primary Examiner* — Terrence Till

(57) ABSTRACT

A compressor wheel is re-designed to permit die inserts (20), which occupy the air passage and define the blades (4, 5) during a process of forming a wax pattern (21) of a compressor wheel, to be pulled without being impeded by the blades. This modified blade design enables the automated production of wax patterns (21) using simplified tooling. These wax patterns (21) can be used in a large-scale investment casting process, and produce an economical cast titanium compressor wheel which performs aerodynamically at high boost pressure/RPM. The compressor wheel improves low cycle fatigue, withstands high temperatures and temperature changes, and permits operation at high boost pressure ratio while, on the other hand, having low weight, low inertial drag, and high responsiveness. The invention further concerns an economical method for operating an internal combustion engine, comprising providing said engine with an easily manufactured, long-life titanium compressor wheel and driving the titanium compressor wheel at high RPM for increasing combustion air throughput and density.

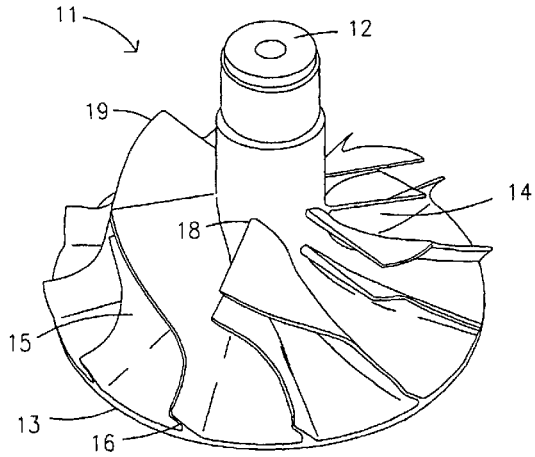

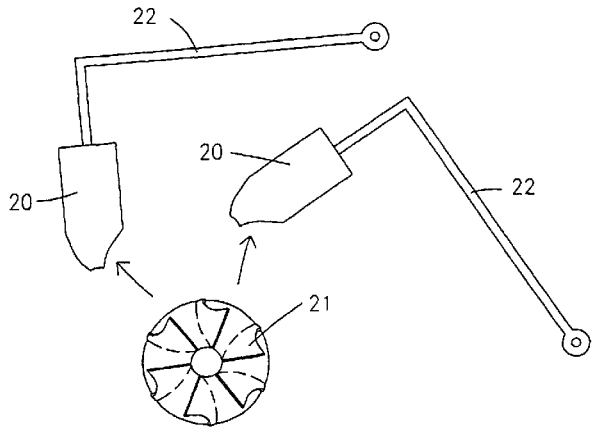

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

The patentability of claims 2, 3 and 7-9 is confirmed.

Claims 1 and 4-6 are cancelled.

* * * * *